US006566804B1

(12) United States Patent
Trujillo et al.

(10) Patent No.: US 6,566,804 B1
(45) Date of Patent: May 20, 2003

(54) FIELD EMISSION DEVICE AND METHOD OF OPERATION

(75) Inventors: Johann T. Trujillo, Mesa, AZ (US); Chenggang Xie, Phoenix, AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/603,493

(22) Filed: Sep. 7, 1999

(51) Int. Cl.[7] ..... H01J 1/62

(52) U.S. Cl. ..... 313/495; 313/496; 313/309; 315/169.1

(58) Field of Search ..... 313/309, 336, 313/351, 495–497; 445/24, 25, 50, 51; 257/10; 315/169.3, 169.1

(56) References Cited

U.S. PATENT DOCUMENTS 3,998,678 A * 12/1976 Fukase et al. ..... 313/309
5,982,082 A * 11/1999 Janning ..... 313/336
6,100,628 A * 8/2000 Coll et al. ..... 313/310
6,147,445 A * 11/2000 Jager et al. ..... 313/336

* cited by examiner

*Primary Examiner*—Vip Patel
*Assistant Examiner*—Joseph Williams
(74) *Attorney, Agent, or Firm*—William E. Koch; Kevin D. Wills

(57) ABSTRACT

A field emission device (200) includes a cathode plate (110) having a back plate (112) made from glass and an anode plate (120) having a transparent substrate (122) also made from glass. A first charge control electrode (152) is affixed to a distal surface (148) of back plate (112), and a second charge control electrode (158) is affixed t0 the periphery of transparent substrate (122). A ballast resistor (114) is disposed on a proximate surface (155) of back plate (112). A method for operating told omission device (200) includes the stop of controlling a potential applied to first charge control electrode (152) in a manner sufficient to control the conductivity of ballast resistor (114) and provide an electron current (138) that is constant. The method further includes the step of controlling a potential applied to second charge control electrode (158) in a manner sufficient to prevent arcing due to wild up or charge within transparent substrate (122).

31 Claims, 1 Drawing Sheet

FIELD EMISSION DEVICE AND METHOD OF OPERATION

FIELD OF THE INVENTION

The present invention relates, in general, to field emission devices, and, more particularly, to methods for operating field emission devices.

BACKGROUND OF THE INVENTION

High voltage field emission devices (FED's) are known in the art. A high voltage FED, is characterized by the application to an anode of the device of a potential greater than about 600 volts, typically more than 1000 volts. Illustrated in FIG. 1 is a partial, cross-sectional view of a prior an high voltage FED 100.

FED 100 includes a cathode plate 110, an anode plate 120 ), and a sealant 130, which are configured to provide a thin envelope. Cathode plate 110 is spaced apart from anode plate 120 to define an interspace region 111. Interspace region 111 is typically evacuated to a pressure of about 10% Torr. A separation distance, d, between anode plate 120 and cathode plate 110 is on the order of one millimeter.

Cathode plate 110 Includes a back plate 112, which is typically made from glass or silicon. Back plate 112 defines a proximate surface 155 and a distal surface 146. A cathode 113 is disposed on proximate surface 155. Cathode 113 is partially defined by a ballast resistor 114, which is a semiconductive layer. Cathode 113 also includes conductive portions, which are connected by ballast resistor 114. Cathode 113 is connected to an electron emitter 118 at one of the conductive portions, thereby operably coupling ballast resistor 111 to electron emitter 118. Cathode 113 supplies electrons to electron emitter 118. Ballast resistor 114 is useful for controlling the flow of electrons to electron emitter 119.

The distance between electron emitter 119 and distal surface 146 is greater than the distance between electron emitter 118 and proximate surface 155. That is, proximate surface 155 is proximately disposed with respect to electron emitter 118, and distal surface 196 is distally disposed with respect to electron emitter 110.

Cathode plate 110 further includes a dielectric layer 116, which is disposed on cathode 113 and defines an emitter well 117. Electron emitter 118 is disposed within emitter well 117. Dielectric layer 116 further defines a surface 140. A gate extraction electrode 119 is disposed upon a portion of surface 140 of dielectric layer 116.

Anode plate 120 is disposed to receive electrons emitted by election emitter 118. Anode plate 120 includes a transparent substrate 122, which is typically made from a glass. Transparent substrate 122 defines a proximate surface 153 and a distal surface 159, which are spaced apart from one another. Proximate surface 153 of transparent substrate 122 partially defines interspace region 111.

An anode 124 is disposed on a portion of proximate surface 153 of transparent substrate 122. Anode 124 is typically made from a transparent conductive material, such as indium tin oxide. A phosphor 126 is disposed upon anode 124. Phosphor 126 is cathodoluminescent and emits light upon activation by electrons.

As further illustrated in FIG. 1, a first voltage source 132 is connected to cathode 113, for applying a cathode voltage thereto; a second voltage source 134 is connected to gate extraction electrode 115, for applying a gate voltage thereto; and a third voltage source 136 is connected to anode 124, for applying an anode voltage thereto. During the operation of FED 100, the cathode voltage, the gate voltage, and the anode voltage are elected to cause and control an electron current 138 from electron emitter 118 and to attract the electrons toward phosphor 116. Electron current 138 can cause ionization of gaseous species that exist within interspace region 111, thereby creating a plurality of ionized species 142.

However, during the operation of prior art FED 100, several forces operate to undesirably change the electrical characteristics of FED 100. The undesirable changes are due at least in part to the presence of mobile electric charges within the components of FED 100.

For example, transparent substrate 122 contains a plurality of mobile charges 150. Because FED 100 is a high voltage device, the anode voltage is a high positive potential, which can be greater than 1000 volts. The high anode voltage causes positive charge within transparent substrate 122 to be repelled away from anode 124 and toward an edge 148 of transparent substrate 122. A build up of positive charge at edge 148 creates the risk of establishing a potential at proximate surface 153 which is sufficient to cause electric arcing over the surface of sealant 130 within interspace region 111. The risk of electric arcing is further exacerbated by the fact that the separation distance between anode plate 120 and cathode plate 110 is very small.

As a further example, back plate 112 has a plurality of mobile charges 144, which are also redistributed during the operation of FED 100. A force, which can cause this change in the distribution of charge, is the electrostatic force due to the accumulation of ionized species 142 at surface 140 of dielectric layer 116. Mobile charges 144 are repelled from proximate surface 155. A change in the charge distribution at proximate surface 155 causes a change in the conductivity of ballast resistor 114. Because ballast resistor 114 is a semiconductor the change in charge distribution at the underlying surface Because charges in the properties of the conductive channel of, ballast resistor 114. An uncontrolled change in the conductivity of ballast resistor 114 causes an undesirable change in the magnitude of electron current 138.

Accordingly, there exists a need for an improved field emission device, which overcomes at least these shortcomings of the prior art.

BRIEF DESCRIPTION OF THE DRAWINGS

Referring to the drawings.

Figure 1:
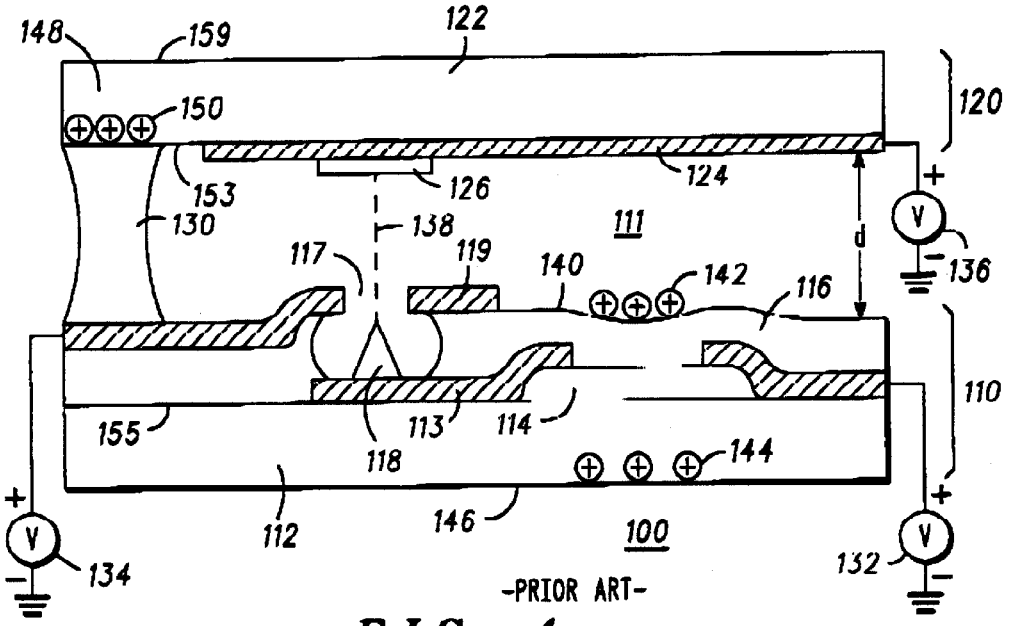
FIG. 1 is a partial, cross-sectional view of a prior art field emission device.

It will be appreciated that for simplicity and clarity of illustration, elements shown in the drawings have not necessarily been drawn to scale. For example, the dimensions of some of the elements are exaggerated relative to each other. Further, where considered appropriate, reference numerals have been repeated among the drawings to indicate corresponding elements.

DESCRIPTION OF THE PREFERRED EMBODIMENTS

The invention is for a field emission device and a method for the operation thereof. The field emission device of the invention has a charge control electrode. The method of the invention includes the step of applying to the charge control electrode a potential, which is useful for controlling mobile charge within a controllable layer of the device. The control of mobile charge can be used to provide benefits, such as controlled emission current, controlled conductivity of a semiconductive layer, reduced risk of electric arcing within the evacuated space of the device, and reduced risk of dielectric breakdown, as contrasted with prior art devices.

Figure 2:
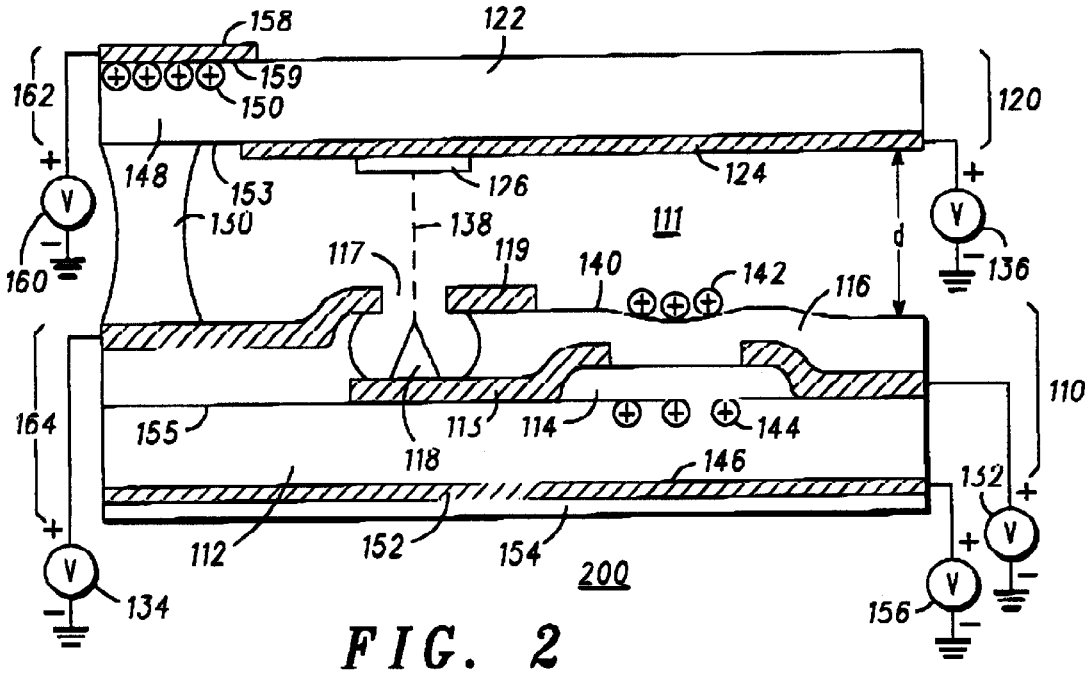
FIG. 2 is a partial, cross-sectional view of a preferred embodiment of a field emission device having charge control electrodes, in accordance with the invention.

FIG. 2 is a partial, cross-sectional view of a preferred embodiment of a field emission device (FED) 200 having a first charge control electrode 152 and a second charge control electrode 158, in accordance with the invention. Although FIG. 2 illustrates a display device, the scope of the invention is not limited to displays. Rather, the invention can be embodied by other types of field emission devices, such as microwave power amplifier tubes, ion sources, matrix-addressable sources of electrons for electron-lithography, and the like.

In general, the charge control electrode of the invention is useful for controlling mobile charges within a controllable layer of the FED. The control of mobile charges within the controllable layer can be used to provide benefits, such as a controlled electron current, a controlled conductivity of a semiconductive layer, a reduced risk of electric arcing within interspace region 111, and a reduced risk of dielectric breakdown, as contrasted with prior art devices, which do not have the charge, control electrode of the invention.

One of the controllable layers of FED 200 is back plate 112. In accordance with the invention, first charge control electrode 152 is affixed to distal surface 146 of back plate 112. First charge control electrode 152 is positioned to cause mobile charges 144 to move toward ballast resistor 114 during the operation of FED 200. First charge control electrode 157 is a conductive layer and is preferably a conductive tape. An insulating layer 154 is affixed to first charge control electrode 152. The combination of cathode plate 110 and first charge control electrode 152 provides a first charge-controlled plate 164. A fourth voltage source 156 is connected to first charge control electrode 152 for controlling the potential applied thereto.

Another controllable layer of FED 200 is transparent substrate 122. In accordance with the invention, second charge control electrode 150 is affixed to distal surface 159 at edge 148 of transparent substrate 122. Second charge control electrode 158 opposes at least the portion of proximate surface 153, which is not covered by anode 124. Second charge control electrode 158 is preferably made from indium tin oxide. The combination of anode plate 120 and second charge control electrode 158 provides a second charge-controlled plate 162. A fifth voltage source 160 is connected to second charge control electrode 158 for controlling the potential applied thereto.

In general, the method of the invention for operating a field emission device includes the step of controlling the distribution within the controllable layer of the plurality of mobile charges. Thus, the method for operating FED 200 includes the step of controlling the distribution within back plate 112 of mobile charges 144. In the operation of the embodiment of FIG. 2, mobile charges 144 are caused to accumulate at proximate surface 155 to an extent sufficient to provide a selected conductivity of ballast resistor 114.

In accordance with the invention, the step of controlling a distribution within back plate 112 of mobile charges 144 in a manner sufficient to control the conductivity of ballast resistor 114 preferably includes the steps of applying a potential to first charge control electrode 152 and controlling the potential at first charge control electrode 152.

In general, for a given ballast resistor, the potential at the charge control electrode, which provider a desired conductivity of the ballast resistor, will depend upon multiple variables, such as the thickness of the back plate, the type of material of the back plate, the concentration and mobility of the mobile charges within the back plate, the anode potential, and the pressure within the interspace region during the operation of the device. The change in pressure due to, for example, outgassing from the anode plate depends in part upon the volume of the interspace region and, thus, upon the separation distance, d, between the anode plate and the cathode plate.

In accordance with the method of the invention, electron current 138 can be controlled by controlling he voltage at first charge control electrode 152. Electron emitter 118 is caused to emit electron current 138 by applying potentials to gate extraction electrode 119 and cathode 113 suitable for causing electron emission. For example, a positive potential of about 110 volts ran be applied to gate extraction electrode 119 and ground potential can be applied to cathode 113. During the source of operation of FED 200, conditions within FED 200 may change and cause a drop in the magnitude of electron current 138. The magnitude of electron current 138 can drop due to, for example, contamination of electron emitter 118 and/or a change in the sharpness of the emissive tip of electron emitter 118.

Electron current 130 can be kept constant by reducing the resistance of ballast resistor 114 by an amount sufficient to compensate for any drop in electron current 130. The method of the invention thus provides an additional way to adjust electron current 138, in addition to manipulation of the voltage at gate extraction electrode 119. This is particularly beneficial because the gate voltage may have an upper limit dictated by the limitations of the driver (not shown), The method for operating FED 200 further includes the step of controlling the distribution within transparent substrate 122 of mobile charges 150 During the operation of the embodiment of FIG. 2, mobile charges 150 are caused to move away from proximate surface 153, particularly at the portion thereof that is not covered by anode 124. In accordance with the method of the invention, the step of controlling the distribution of mobile charges 150 includes the step of controlling the distribution of mobile charges 150 in 4 manner sufficient to prevent arising within interspace region 111 due to build up of charge at proximate surface 153.

This step is preferably achieved by controlling the potential at second charge control electrode 150. That is, the potential at second charge control electrode 158 is controlled to attract mobile charges 150 thereto, to an extent sufficient to prevent establishing a voltage at proximate surface 153, which would cause arcing within interspace region 111. The potential applied at second charge control electrode 158 depends upon multiple variables, such as the thickness of transparent substrate 122, the material of transparent substrate 122, the concentration and mobility of mobile charges 150, the anode voltage, and the conditions, such as the pressure, within interspace region 111.

Ballast resistor 114 can also constitute a controllable layer of FED 240. Ballast resistor 114 is preferably made from amorphous silicon, which has mobile charge in the form of majority and minority carriers. First charge control electrode 152 and back plate 112 provide the means operably coupled to ballast resistor 114 for controlling the distribution within ballast resistor 114 of the mobile charges.

In the preferred embodiment of FIG. 2, back plate 112 and transparent substrate 122 are glass layers, preferably made from soda lime glass, each having a thickness of about 1.1 millimeters. Further in the embodiment of FIG. 2, the separation distance, d, between anode plate 120 and cathode plate 110 is preferably equal to less than 5 millimeters, but not constrained thereto. Most preferably, it is equal to about 1 millimeter.

In accordance with the method of the invention, the potential applied to anode 124 is preferably greater than 600 volts, and most preferably equal to about 3000 volts. Further in accordance with the method of the invention, the potential at first charge control electrode 157 is most preferably maintained within a range of 100–500 volts, and the potential at second charge control electrode 158 is most preferably maintained at ground potential.

In summary, the field omission device and the method of the invention are useful for controlling the distribution of mobile charge within the device to provide numerous benefits, such as constant electron current and controlled conductivity of a ballast resistor. Further benefits include reduced risk of electric arcing within the evacuated space of the device and reduced risk of dielectric breakdown, as contrasted with prior art devices.

While we have shown and described specific embodiments of the present invention, further modifications and improvements will occur to those skilled in the art. For example, the method of the invention can be used to prevent the breakdown of dielectric layer 116. This example of the method of the invention includes the step of controlling a distribution within back plate 112 of mobile charges 144 in a manner sufficient to prevent the breakdown of dielectric layer 116.

We desire it to be understood, therefore, that this invention is not limited to the particular forms shown, and we intend in the appended claims to cover all modifications that do not depart from the spirit and scope of this invention.

What is claimed is:

1. A field emission device comprising:

an electron emitter;

an anode plate and a cathode plate, wherein the cathode plate is spaced apart from the anode plate to define an interspace region therebetween;

the anode plate further including a glass plate defining a proximate surface and a distal surface, wherein a distance between the electron emitter and the distal surface is greater than a distance between the electron emitter and the proximate surface; and a charge control electrode disposed on the distal surface of the glass plate of the anode plate.

2. The field emission device as claimed in claim 1, wherein the glass plate comprises soda lime glass.

3. The field emission device as claimed in claim 1, wherein the proximate surface of the glass plate partially defines the interspace region.

4. The field emission device as claimed in claim 1, wherein the cathode plate includes a glass plate defining a proximate surface and a distal surface, wherein a distance between the electron emitter and the distal surface is greater than a distance between the electron emitter and the proximate surface, and a semiconductive layer, wherein the semiconductive layer is disposed on the proximate surface of the glass plate of the cathode plate.

5. The field emission device as claimed in claim 4, further comprising a charge control electrode disposed on the distal surface of the glass plate of the cathode plate.

6. The field emission device as claimed in claim 1, wherein the charge control electrode of the anode plate comprises indium tin oxide.

7. The field emission device as claimed in claim 5, wherein the charge control electrode of the cathode plate comprises a conductive tape.

8. A field emission device comprising:

a controllable layer defining a portion of an anode plate, the controllable layer having a plurality of mobile charges within; and means operably coupled to the controllable layer for controlling a distribution within the controllable layer of the plurality of mobile charges.

9. The field emission device as claimed in claim 8, wherein the controllable layer comprises a glass.

10. The field emission device as claimed in claim 8, wherein the controllable layer comprises silicon.

11. A field emission device comprising:

an electron emitter, an anode plate and a cathode plate, wherein the cathode plate has positioned thereon a proximate surface the electron emitter, the cathode plate being spaced apart from the anode plate to define an interspace region therebetween;

the anode plate including a glass plate defining a proximate surface and a distal surface, wherein the proximate surface is proximately disposed with respect to the electron emitter, and wherein the distal surface is distally disposed with respect to the electron emitter; and a charge control electrode disposed on the distal surface of the glass plate of the anode plate.

12. A method for operating a field emission device wherein the anode plate includes a controllable layer having a plurality of mobile charges, the method comprising the step of controlling a distribution within the controllable layer of the plurality of mobile charges.

13. The method for operating a field emission device as claimed in claim 12, wherein the controllable layer of the anode plate defines a proximate surface, wherein the proximate surface of the controllable layer partially defines the interspace region, and wherein the step of controlling a distribution of the plurality of mobile charges comprises the step of controlling a distribution of the plurality of mobile charges in a manner sufficient to prevent arcing within the interspace region due to build up of charge at the proximate surface of the controllable layer of the anode plate.

14. The method for operating a field emission device as claimed in claim 13, wherein the controllable layer of the anode plate further defines a distal surface, wherein the distal surface is spaced apart from the proximate surface, and wherein the step of controlling a distribution of the plurality of mobile charges in a manner sufficient to prevent arcing comprises the steps of:

providing a charge control electrode at the distal surface of the controllably layer of the anode;

applying a potential to the charge control electrode; and controlling the potential at the charge control electrode.

15. The method for operating a field emission device as claimed in claim 12, wherein the cathode plate further includes a controllable layer having a semiconductive layer disposed on the proximate surface of the controllable layer and a plurality of mobile charges within, and wherein the step of controlling a distribution within the controllable layer of the cathode plate of the plurality of mobile charges comprises the step of controlling a distribution within the controllable layer of the plurality of mobile charges in a manner sufficient to control the conductivity of the semiconductive layer.

16. The method for operating a field emission device as claimed in claim 15, wherein the controllable layer of the cathode plate further, defines a distal surface, wherein the distal surface is spaced apart from the proximate surface, and wherein the step of controlling a distribution within the controllable layer of the cathode plate of the plurality of mobile charges in a manner sufficient to control the conductivity of the semiconductive layer comprises the steps of:

providing a charge control electrode at the distal surface of the controllable layer of the cathode plate;

applying a potential to the charge control electrode; and controlling the potential at the charge control electrode.

17. The method for operating a field emission device as claimed in claim 12, further comprising the steps of:

providing between the anode plate and the cathode plate a separation distance equal to less than 5 millimeters; and applying to the anode plate a potential greater than 600 volts.

18. A method for operating a field emission device having an electron emitter, a controllable layer disposed within an anode plate and defining a proximate surface and a distal surface, and a charge control electrode disposed on the distal surface of the controllable layer, the method comprising the steps of:

causing the electron emitter to emit an electron current; and applying a potential to the charge control electrode in a manner sufficient to control a plurality of mobile charges in the controllable layer disposed within the anode plate.

19. A method for operating a field emission device having an anode plate including a glass layer having a plurality of mobile charges within, the method comprising the step of controlling a distribution within the glass layer of the plurality of mobile charges.

20. The method for operating a field emission device as claimed in claim 19, wherein the field emission device further includes a cathode plate, wherein the anode plate is spaced apart from the cathode plate to define an interspace region therebetween, wherein the glass layer of the anode plate defines a proximate surface, wherein the proximate surface of the glass layer partially defines the interspace region, and wherein the step of controlling a distribution of the plurality of mobile charges comprises the step of controlling a distribution of the plurality of mobile charges in a manner sufficient to prevent arcing within the interspace region due to build up of charge at the proximate surface of the glass layer.

21. The method for operating a field emission device as claimed in claim 20, wherein the glass layer of the anode plate further defines a distal surface, wherein the distal surface is spaced apart from the proximate surface, and wherein the step of controlling a distribution of the plurality of mobile charges in a manner sufficient to prevent arcing comprises the steps of:

providing a charge control electrode at the distal surface of the glass layer of the anode plate;

applying a potential to the charge control electrode; and controlling the potential at the charge control electrode.

22. The method for operating a field emission device as claimed in claim 19, wherein the cathode plate include a glass layer having a proximate surface, wherein the field emission device further has a semiconductive layer disposed on the proximate surface of the glass layer of the cathode plate, and wherein the step of controlling a distribution within the glass layer of the cathode plate of the plurality of mobile charges comprises the step of controlling a distribution within the glass layer of the cathode plate of the plurality of mobile charges in a manner sufficient to control the conductivity of the semiconductive layer.

23. The method for operating a field emission device as claimed in claim 22, wherein the glass layer of the cathode plate further defines a distal surface, wherein the distal surface is spaced apart from the proximate surface, and wherein the step of controlling s distribution within the glass layer of the plurality of mobile charges in a manner sufficient to control the conductivity of the semiconductive layer comprises the steps of:

providing a charge control electrode at the distal surface of the glass layer;

applying a potential to the charge control electrode; and controlling the potential at the charge control electrode.

24. The method for operating a field emission device as claimed in claim 19, further comprising the steps of:

providing between the anode plate and the cathode plate a separation distance equal to less than 6 millimeters; and applying to the anode plate a potential greater than 600 volts.

25. A method for operating a field emission device having an electron emitter, an anode plate including a glass layer defining a proximate surface and a distal surface, a cathode plate including a glass layer defining a proximate surface and a distal surface, a semiconductive layer disposed on the proximate surface of the glass layer of the cathode plate and operably coupled to the electron emitter for supplying electrons thereto, a charge control electrode disposed on the distal surface of the glass layer of the anode plate, and a charge control electrode disposed on the distal surface of the glass layer of the cathode plate, the method comprising the steps of:

causing the electron emitter to emit an electron current; and applying a potential to the charge control electrode of the anode plate and the charge control electrode of the cathode plate in a manner sufficient to control the electron current.

26. The method for operating a field emission device as claimed in claim 25, wherein the step of applying a potential to the charge control electrode of the anode plate and the charge control electrode of the cathode plate in a manner sufficient to control the electron current comprises the step of applying a potential to the charge control electrode of the anode plate and the charge control electrode of the cathode plate in a manner sufficient to maintain the electron current at a constant value.

27. A method for operating a field emission device having an anode plate and a cathode plate, the method comprising the steps of:

providing between the anode plate and the cathode plate a separation distance equal to less than 5 millimeters;

applying to the anode plate a potential greater than 600 volts;

affixing a charge control electrode to the anode plate, thereby defining a charge-controlled plate;

applying a potential to the charge control electrode; and controlling the potential applied to the charge control electrode in a manner sufficient to control a distribution of a plurality of mobile charges within the charge-controlled plate.

28. The method for operating a field emission device as claimed in claim 27, wherein the anode plate has a glass layer having a thickness of about 1.1 millimeters, wherein the step of providing between the anode plate and the cathode plate a separation distance comprises the step of providing between the anode plate and the cathode plate a separation distance equal to about 1 millimeter, wherein the step of applying to the anode plate a potential greater than 600 volts comprises the step of applying to the anode plate a potential of about 3000 volts, and wherein the steps of applying a potential to the charge control electrode and controlling the potential applied to the charge control electrode comprise the step of maintaining at the charge control electrode a potential within a range of 100–500 volts.

29. The method for operating a field emission device as claimed in claim 28, wherein the glass layer of the anode plate comprises soda lime glass.

30. The method for operating a field emission device as claimed in claim 27, wherein the cathode plate has a glass layer having a thickness of about 1.1 millimeters, and further includes a step of affixing a charge control electrode to a glass layer of the cathode plate wherein the step of providing between the anode plate and the cathode plate a separation distance comprises the step of providing between the anode plate and the cathode plate a separation distance equal to about 1 millimeter, wherein the step of applying to the anode plate a potential greater than 600 volts comprises the step of applying to the anode plate a potential of about 3000 volts, and wherein the steps of applying a potential to the charge control electrode and controlling the potential applied to the charge control electrode comprise the step of maintaining at the charge control electrode ground potential.

31. The method for operating a field emission device as claimed in claim 30, wherein the glass layer of the cathode plate comprises soda lime glass.

* * * * *